US005232045A

United States Patent [19]

Cretella et al.

[11] Patent Number: 5,232,045

[45] Date of Patent: Aug. 3, 1993

[54] BILLET CASTER MODULAR MOLD SCAFFOLD

[75] Inventors: Ronald S. Cretella, Cranberry Township, Butler County, Pa.; Richard A. Baker, East Liverpool, Ohio

[73] Assignee: Westinghouse Electric Corp., Pittsburgh, Pa.

[21] Appl. No.: 753,143

[22] Filed: Aug. 30, 1991

[51] Int. Cl.[5] ..... B22D 11/12

[52] U.S. Cl. ..... 164/448; 164/442

[58] Field of Search ..... 164/448, 442

[56] References Cited

U.S. PATENT DOCUMENTS

| | | | |
|---|---|---|---|
| 2,284,503 | 5/1942 | Williams | 164/442 X |
| 2,770,021 | 11/1956 | Harter, Jr. et al. | 164/442 X |
| 3,366,162 | 1/1968 | Barbe et al. | 164/442 |
| 4,202,397 | 5/1980 | Hlinka et al. . | |
| 4,214,623 | 7/1980 | Jaenson . | |
| 4,246,812 | 1/1981 | Gladwin et al. . | |
| 4,255,863 | 3/1981 | Lazzaretti . | |
| 4,290,478 | 9/1981 | Kagerhuber et al. | 164/448 |
| 4,351,383 | 9/1982 | Gladwin | 164/448 |
| 4,383,571 | 5/1983 | Frantz et al. | 164/446 |
| 4,603,729 | 8/1986 | Kawaguchi et al. | 164/448 X |
| 4,905,754 | 3/1990 | Kimura et al. | 164/448 X |

FOREIGN PATENT DOCUMENTS

| | | | |
|---|---|---|---|
| 1483552 | 2/1969 | Fed. Rep. of Germany | 164/448 |
| 1208611 | 10/1970 | United Kingdom | 164/448 |

*Primary Examiner*—J. Reed Batten, Jr.
*Attorney, Agent, or Firm*—G. H. Telfer

[57] ABSTRACT

A billet mold scaffold includes a plurality of mold modules carried by a frame defined by a plurality of legs, each of which is separately attachable and removable relative to the modules. Each mold module contains a plurality of rollers, for example, four, which are adjustable to accommodate various billet diameters. The mold modules are virtually identical and are carried by a frame formed to a predetermined casting radius. The frame is predrilled such that the attachment of the modules by way of the predrilled holes to the frame will rather easily and quickly provide a mold scaffold formed to a predetermined casting radius without the need to adjust each roll horizontally, vertically or angularly as in the prior art. Moreover, during a breakout condition, the modules and each of the legs of the frame can be rather easily and quickly replaced in the field. Each leg of the frame is also used to carry the cooling water which eliminates the need for spray water piping as in existing mold scaffolds.

12 Claims, 5 Drawing Sheets

BILLET CASTER MODULAR MOLD SCAFFOLD

BACKGROUND OF THE INVENTION

1. Field of the Invention

The present invention relates to a device for use in a continuous casting process and more particularly to a modular mold scaffold for billets and the like which forms a portion of a continuous casting mold which includes a plurality of mold modules which can be rather easily and precisely assembled to a predetermined casting radius.

2. Description of the Prior Art

Continuous casting of billets involves a continuous flow of molten steel from a ladle or tundish into a billet mold formed from a plurality of segments, connected together to form a predetermined casting radius. For example, 26 foot, 30 foot and 40 foot casting radii are known. The molten steel is cooled, and solidified as it passes through the various segments of the continuous caster. In a billet caster the molten steel from the ladle or tundish is formed into a billet in a first segment by a water cooled billet mold. At this stage of the continuous casting process, the billet leaves the billet mold with a molten center. The billet is continuously cooled as it passes through downstream segments of the continuous caster. The various downstream segments contain the solidified outer shell of the billet while additional cooling is provided to cool the molten center.

One of the downstream segments is known as a mold scaffold. The mold scaffold is directly connected to the billet mold and includes a plurality of stages through which the billet passes while additional cooling is applied. Each stage of the mold scaffold includes a plurality of rollers, for example, four rollers, for containing the outer shell of the billet as the additional cooling water is applied. In order to maintain the predetermined casting radius, each stage of the scaffold must be relatively precisely positioned and secured to a scaffold frame. This requires each of the four rolls, for example, in each of the scaffold stages to be relatively precisely aligned both horizontally and vertically as well as angularly to the casting radius. Consequently, such scaffolds are relatively expensive to manufacture.

Additionally, if a condition known as breakout occurs, an entire scaffold has been known to be replaced. A breakout condition occurs when the solidified shell of the billet ruptures which causes a flow of the molten steel in the center of the billet to break out and flow all over the particular segment at which the breakout occurs. When breakout occurs in a mold scaffold, one or more stages of the mold scaffold may be covered with molten steel which solidifies, thus necessitating removal of the mold scaffold to attempt to remove the molten steel with a burning torch, for example. However, in some cases when breakout results in molten metal covering the frame, which may be of unitary design, as well as the rollers, it is sometimes difficult if not impossible to clean the scaffold and realign it for subsequent use.

SUMMARY OF THE INVENTION

It is an object of the invention to solve the problems associated with the prior art.

It is another object of the present invention to provide a mold scaffold which is relatively easily formed into a predetermined casting radius.

It is yet another object of the present invention to provide a mold scaffold which facilitates cleaning after a breakout condition.

Briefly, the present invention relates to a billet mold scaffold which include a plurality of mold modules. Each mold module contains a plurality of rollers, for example, four, which are adjustable to accommodate various billet diameters. The modules are virtually identical and are carried by a frame formed to a predetermined casting radius. The frame includes a plurality of legs, for example, four, each of which may be separately attached or removed relative to the modules. Each leg of the frame is predrilled such that the attachment of the modules by way of the predrilled holes to the leg will rather easily and quickly provide a mold scaffold formed to a predetermined casting radius without the need to adjust each roll horizontally, vertically or angularly as in the prior art. Moreover, during a breakout condition, the modules as well as each leg of the frame can be rather easily and quickly replaced in the field. Moreover, the legs of the frame are formed to carry cooling water which eliminates the need for spray water piping as in existing scaffolds.

BRIEF DESCRIPTION OF THE DRAWING

These and other objects and advantages of the present invention will become readily apparent upon consideration of the following detailed description and attached drawing, wherein.

DETAILED DESCRIPTION OF THE PREFERRED EMBODIMENT

Figure 1:
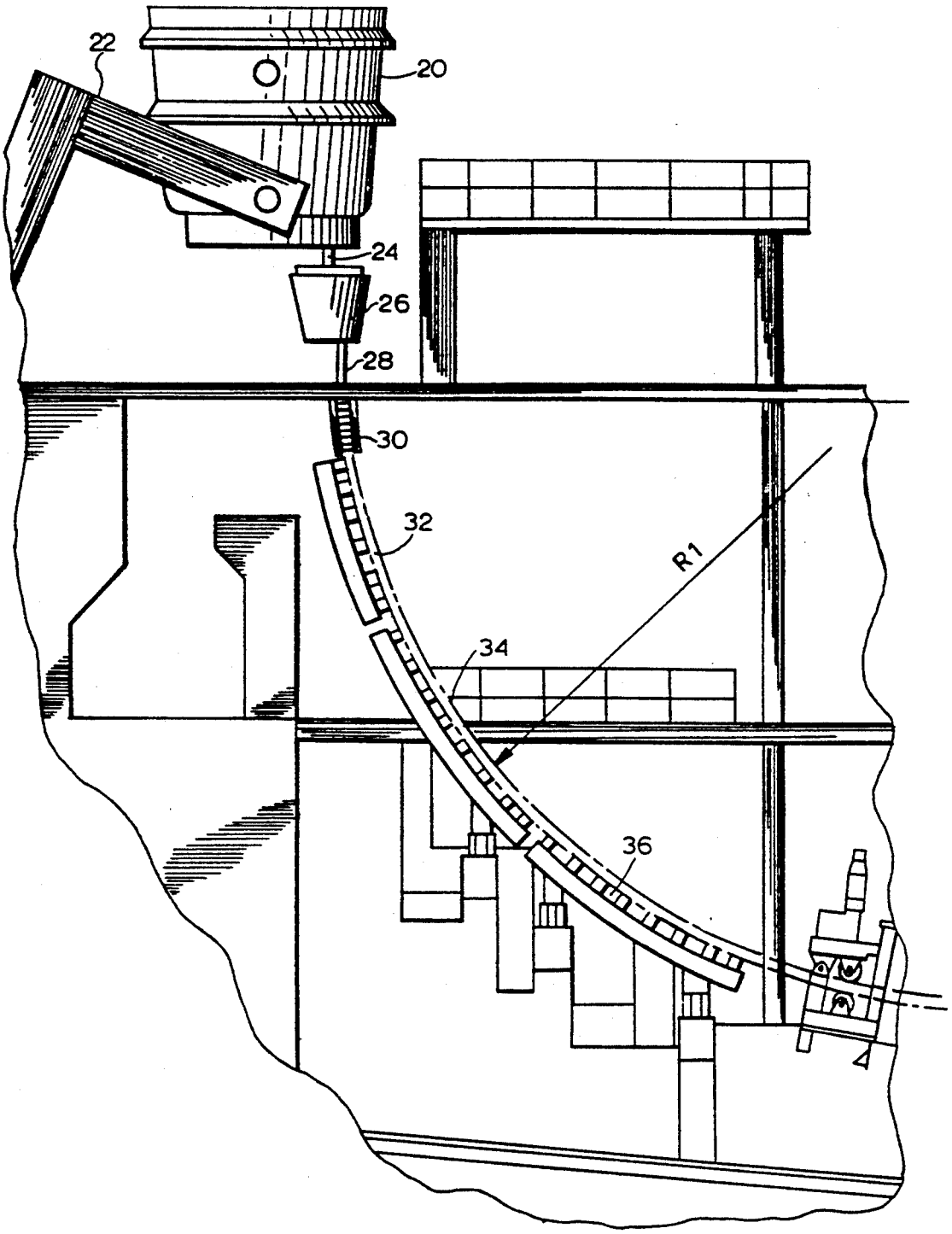
FIG. 1 is a partial elevational view of a billet caster.

A partial elevational view of a continuous billet caster is illustrated in FIG. 1. Molten steel from a ladle 20, carried by a ladle turret 22, flows by gravity by way of a ladle nozzle 24 into a tundish 26. Molten steel from the tundish 26 flows by gravity into a billet mold 28. The billet mold 28 is water cooled to form an outer shell in the shape of a billet with a molten center.

Figure 6:
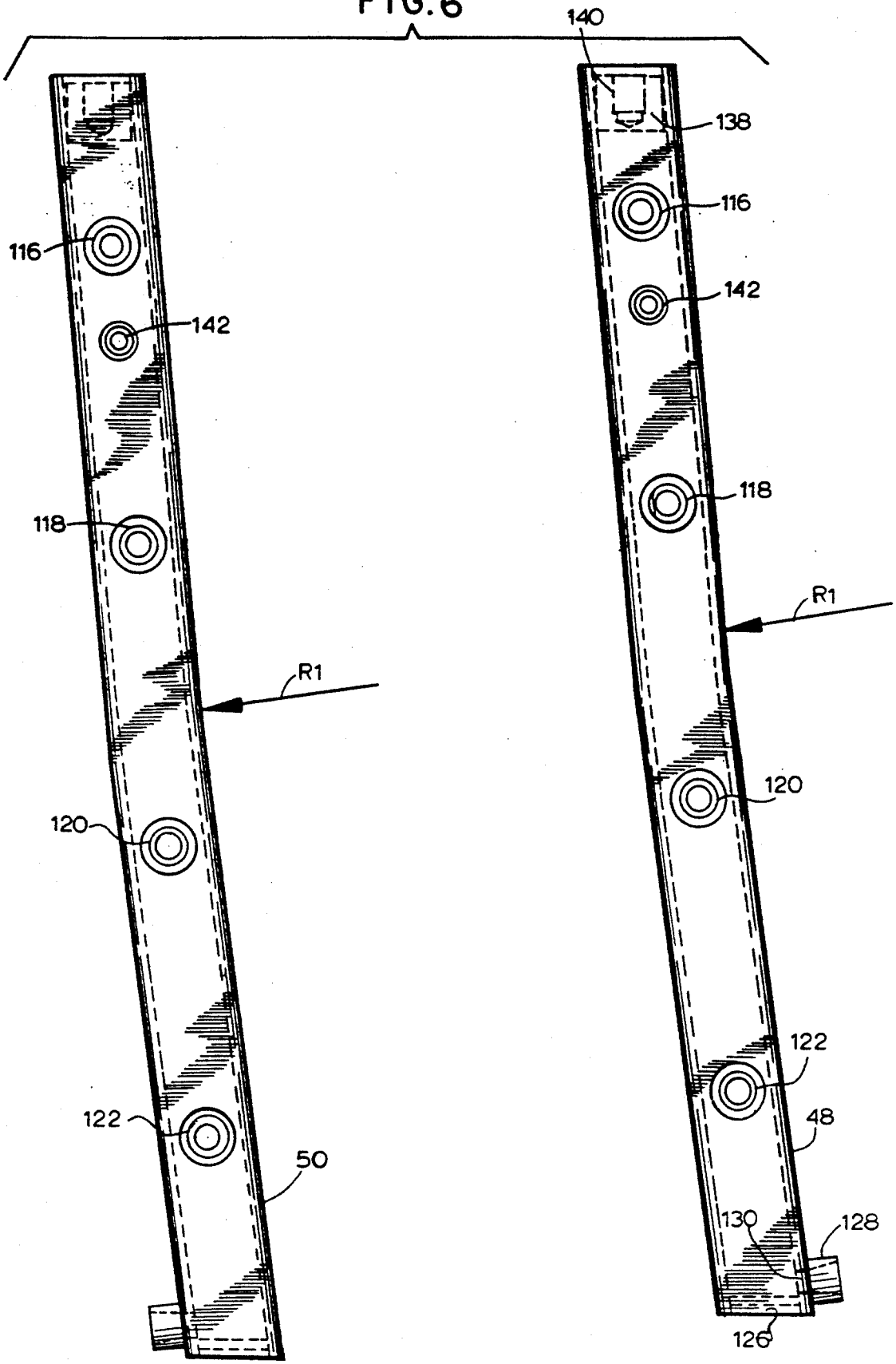
FIG. 6 is an elevational view of the inner and outer legs of the frame for carrying the modules in accordance with the present invention.

The mold scaffold 30 in accordance with the present invention is connected downstream of the billet mold 28. The mold scaffold 30 guides the billet shell with the molten center to other segments in the casting process while additional cooling is provided. The mold scaffold 30 as well as the downstream segments including the strands 32, 34 and 36 are all formed to a predetermined casting radius R1 indicated in FIGS. 1 and 6 provide additional cooling for the billet as it flows along the casting radius.

As is known in the art, each of the segments in the continuous casting process including the mold scaffold 30 must be relatively precisely formed to the casting radius R1. In known scaffold designs, this can result in the manufacture of a mold scaffold being relatively expensive. Moreover, should a breakout occur at a point along the mold scaffold, it has been known to replace an entire mold scaffold due to the unitary frame and difficulty in forming known mold scaffolds to the casting radius.

The present invention solves this problem by providing a mold scaffold 30, which includes a plurality of modules, for example, four modules, 38, 40, 42 and 44 (FIG. 2), carried by a frame, generally identified with the reference numeral 46, which includes a pair of inner legs 48 and a pair of outer legs 50, formed to the casting radius R1. In order to facilitate assembly of the modules 38, 40, 42 and 44 to the frame 46, each of the legs 48 and 50 are relatively precisely predrilled such that the modules 38, 40, 42 and 44 can rather easily and quickly be attached to the frame 46 and aligned along the casting radius R1 without further adjustment to form the mold scaffold 30. The assembly 30 may then be rather easily and conveniently attached to a billet mold 28 as shown best in FIG. 2 with a plurality of fasteners 52.

Figure 3:
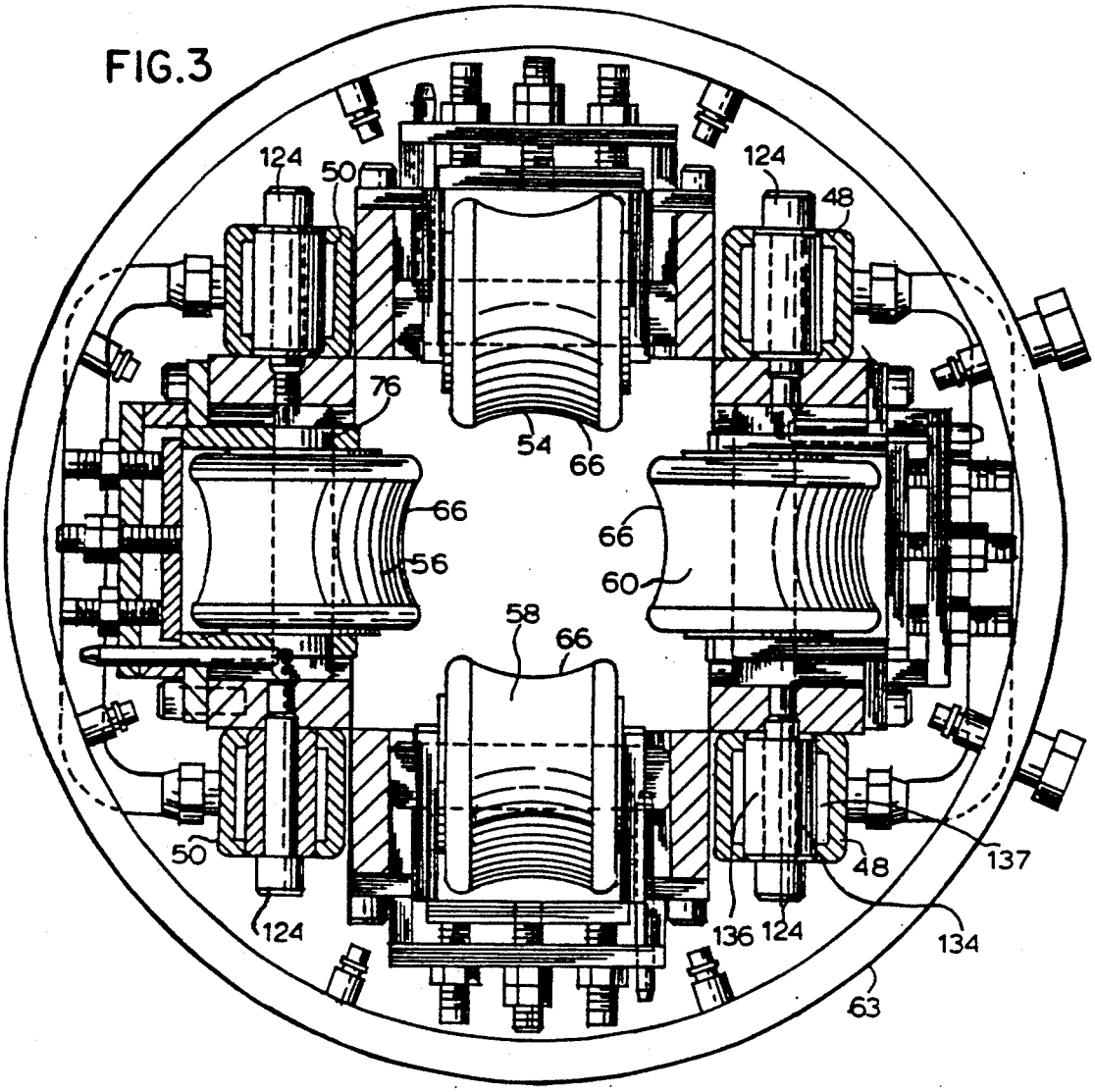
FIG. 3 is a cross-sectional view along line 3—3 of FIG. 2.
Figure 4:
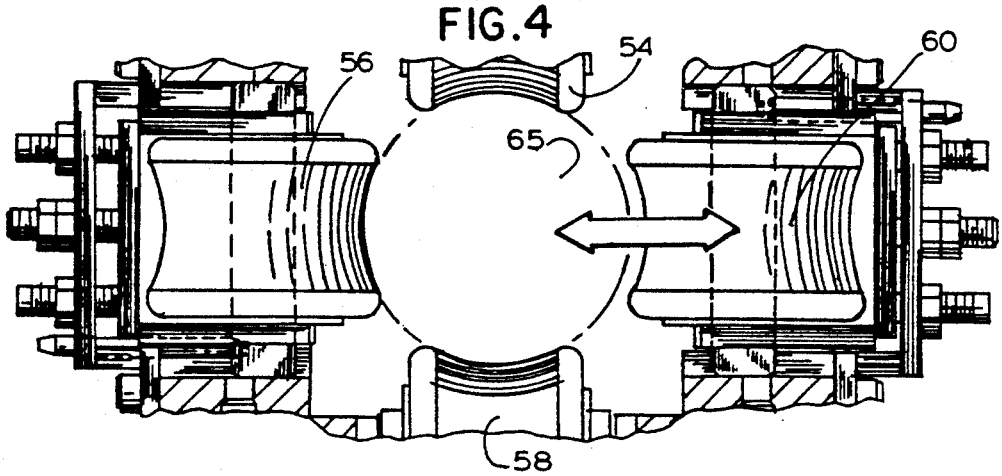
FIG. 4 is a partial plan view of one module in accordance with the present invention.
Figure 5:
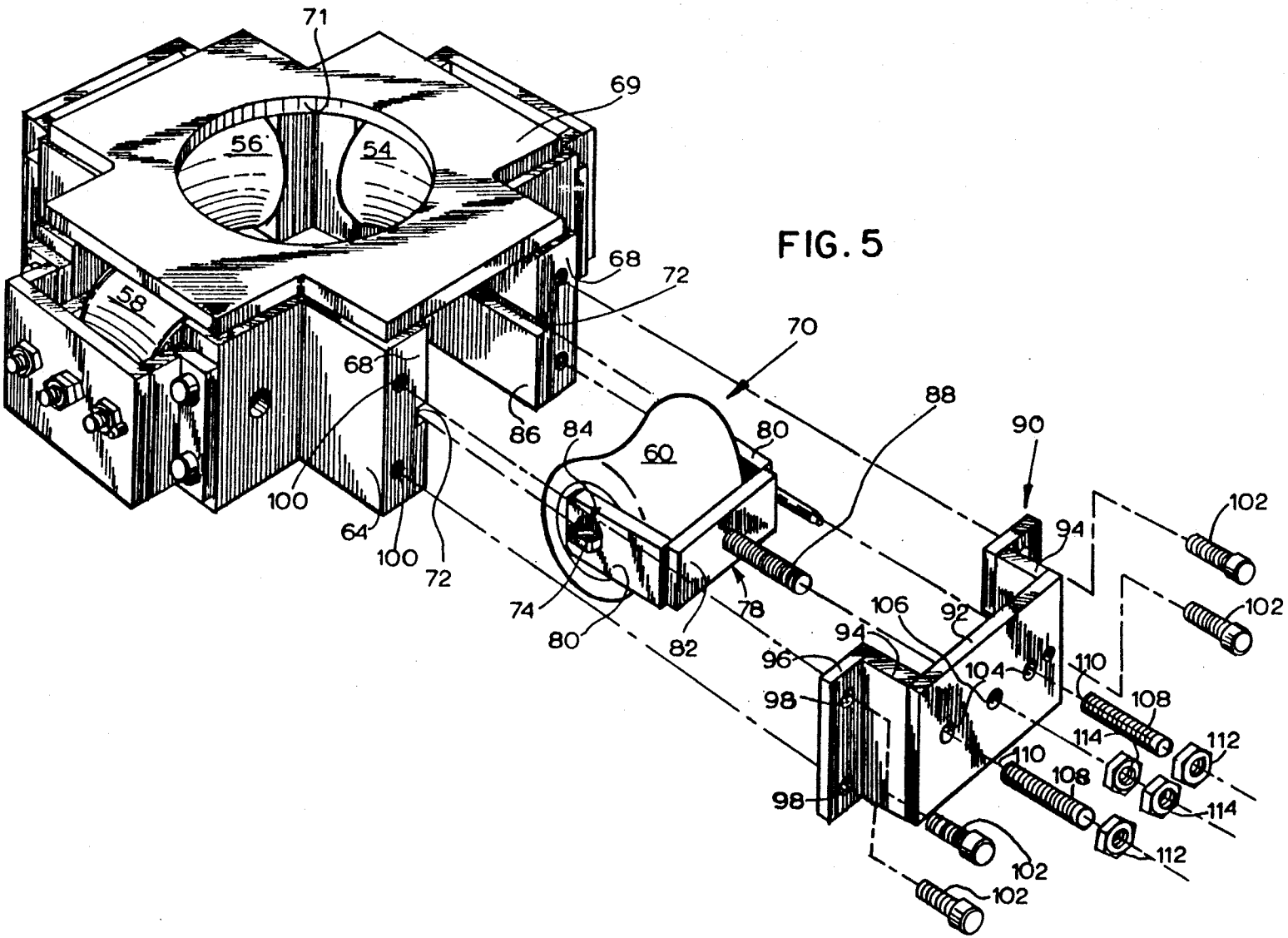
FIG. 5 is an exploded perspective view of a roll module in accordance with the present invention.

As will be discussed in more detail below, each of the modules 38, 40, 42 and 44 are provided with four rollers 54, 56, 58 and 60. Each of the rollers 54, 56, 58 and 60 are adjustable to accommodate various diameter billets 62. As illustrated in FIGS. 3–5, each module 38, 40, 42 and 44 includes four rollers 54, 56, 58 and 60. As best illustrated in FIG. 4 and as will be described below, each roller 54, 56, 58 and 60 is adjustable in a direction perpendicular to its axis as indicated by the arrow 65.

The rollers 54, 56, 58 and 60 guide the shell of the billet, which at this point has a molten center along the casting radius while additional cooling is provided. An important aspect of the invention relates to the fact that the frame 46 as will be discussed below additionally acts as a conduit for cooling water either in addition or in place of known spray rings 63, as illustrated in FIG. 3.

The rollers 54, 56, 58 and 60 are carried by a module frame 64 which carries the rollers 54, 56, 58 and 60 which define the arcuate roller surfaces 66 which form a portion of a circle as shown in FIG. 3. Each module frame 64 is formed in a generally cross shape defining four pairs of spaced apart side walls 68 for receiving roller assemblies 70 and closed with coextensive plates 69 formed with a centrally disposed aperture 71. Each of the side walls 68 is provided with a keyway 72 for receiving keys 74 formed on opposing ends of axle rollers 76 which carry the rollers 54, 56, 58 and 60. The arrangement of the keyway 72 and the keys 74 formed on opposing ends of the axle roller 76 prevent the axle 76 from rotating relative to the module frame 64.

Each of the roller assemblies 70 includes a generally U-shaped bracket 78, defining a pair of depending legs 80 and a bight portion 82. The depending legs 80 are provided with aligned apertures 84 for receiving the roller axles 76. The roller axles 76 are generally formed with a circular cross-section intermediate the ends with the keys 74 disposed on opposing ends. The length of the roller axle 76 is such that the keys 74 extend outwardly from the depending leg 80 of the U-shaped bracket 78. Moreover, the distance between the depending legs 80 of the U-shaped bracket 78 is provided such that the depending legs 80 can be rather easily disposed adjacent the inner surfaces 86 of the side walls 68. A lug 88 is rigidly connected to the bight portion 82 of the U-shaped bracket 78.

A hat-shaped bracket 90 is used to secure the roller assembly 70 to the module frame 64 as well as provide means for adjusting the roller assembly 70. More particularly, the hat-shaped bracket 90 includes a bight portion 92 and two spaced apart depending leg portions 94. Flange portions 96 are disposed generally perpendicular to the depending leg portions 94. The flange portions 96 are provided with a pair of spaced apart apertures 98. The apertures 98 are adapted to be aligned with threaded apertures 100 provided in the side wall 68 of the module frame 64. This allows the hat-shaped bracket 90 to be secured to the module frame 64 by way of fasteners 102 which, in turn, secures the roller assembly 70 relative to the module frame 64.

The bight portion 92 of the hat-shaped bracket 90 is provided with two spaced apart threaded apertures 104. Additionally, the bight portion 92 is provided with an unthreaded aperture 106, disposed intermediate the threaded apertures 104 for receiving the extending lug 88 that is rigidly attached to the roller assembly 70. The apertures 104 are provided for adjustment of the roller assemblies 70 while the aperture 106 is provided to secure the roller assembly 70 relative to the bracket 90 after the adjustment. More specifically after the hat-shaped bracket 90 is secured to the module frame 64 as discussed above, the lug 88 will extend through the unthreaded aperture 106 in the hat-shaped bracket 90. In order to adjust the roller assembly 70, a precision fixture, such as a dummy billet (not shown), is disposed within the opening 71 in the plate 69. Customarily, the dummy billet will be disposed such that it runs through all four of the modules 38, 40, 42 and 44. Once the dummy billet is in place, the roller assemblies 70 are simply moved in the direction of the arrow 64 in FIG. 4 (e.g., perpendicular to the roller axis) until the arcuate roller surface 66 engage the dummy billet. At this point, headless fasteners 108 are threaded through the threaded apertures. 104 in the bight portion 92 of the hat-shaped bracket 90. The internally extending ends 110 of these headless fasteners 108 act as stops relative to the bight portion 82 of the U-shaped roller bracket 78 to prevent the roller assembly 70 from moving in a direction toward the hat-shaped bracket 90. Once the roller assemblies 70 are in place, nuts 112 are secured to the headless fasteners 108 to secure the headless fastener 108 from moving during operation. In order to prevent movement of the roller assembly 70 in a direction away from the hat-shaped bracket 90, one or more nuts 114 may be secured to the extending lug 88. This allows the roller assembly 70 to be rather quickly and easily adjusted. In order to change the adjustment of a roller assembly, the process is reversed and simply repeated. Each of the roller assemblies 38, 40, 42 and 44 can be adjusted in a similar manner.

The modules 38, 40, 42 and 44 are carried by the frame 46 which includes two inner legs 48 and two outer legs 50. As shown best in FIG. 6, each of the legs 48 and 50 are formed along a predetermined casting radius as indicated by the arrows. Each of the legs 48 and 50 is predrilled with a plurality of apertures 116, 118, 120 and 122. These apertures 116, 118, 120 and 122 are relatively precisely predrilled at the factory such that when the mold modules 38, 40, 42 and 44 are connected to the legs 48 and 50 by way of the fasteners 124, as shown best in FIGS. 2 and 3, the mold modules 38, 40, 42 and 44 including the roller assemblies 70 will be formed to the predetermined casting radius without further adjustment. Not only does such a construction greatly simplify the manufacture of such mold scaffolds but also simplifies maintenance and replacement in the field since each leg 48, 50 may be individually removed if necessary as opposed to known mold scaffolds which contain a unitary frame.

Another important aspect of the invention is the use of the legs 48 and 50 as a conduit for cooling water. As shown best in FIG. 3, each of the legs 48, 50 is formed with a generally square or rectangular cross-section, for example, from a three inch square tubing having a $\frac{3}{8}''$ wall. A bar 126, for example, $2\frac{1}{4}''$ square and $\frac{1}{4}''$ thick, may be welded on one end of each of the legs 48 and 50 to provide a watertight seal. An aperture 130 may be disposed adjacent one end of the leg 48 or. 50 adjacent the bar 126. A cooling water coupling 128 may be rigidly secured to the leg 48, 50 adjacent the aperture 130.

In order to provide support for attaching the modules 38, 40, 42 and 44 to the legs 48 and 50, the apertures 116, 118, 120 and 122 are drilled to receive a circular bar 134 which may be, for example, $1\frac{1}{2}''$ in diameter by $3\frac{1}{4}''$ long. Each of the bars 34 is provided with a centrally disposed aperture 136 (FIG. 3) for attachment of the mold modules 38, 40, 42 and 44. The bars 134 are securely welded to the legs 48 to provide a watertight seal defining flow channels 137 along the legs 48 and 50 around the bars 134. The bars 134 with the centrally disposed aperture 136 provide sufficient support to allow the modules 38, 40, 42 and 44 to be rigidly attached to the legs utilizing the fasteners 124 as shown in FIG. 4.

Figure 2:
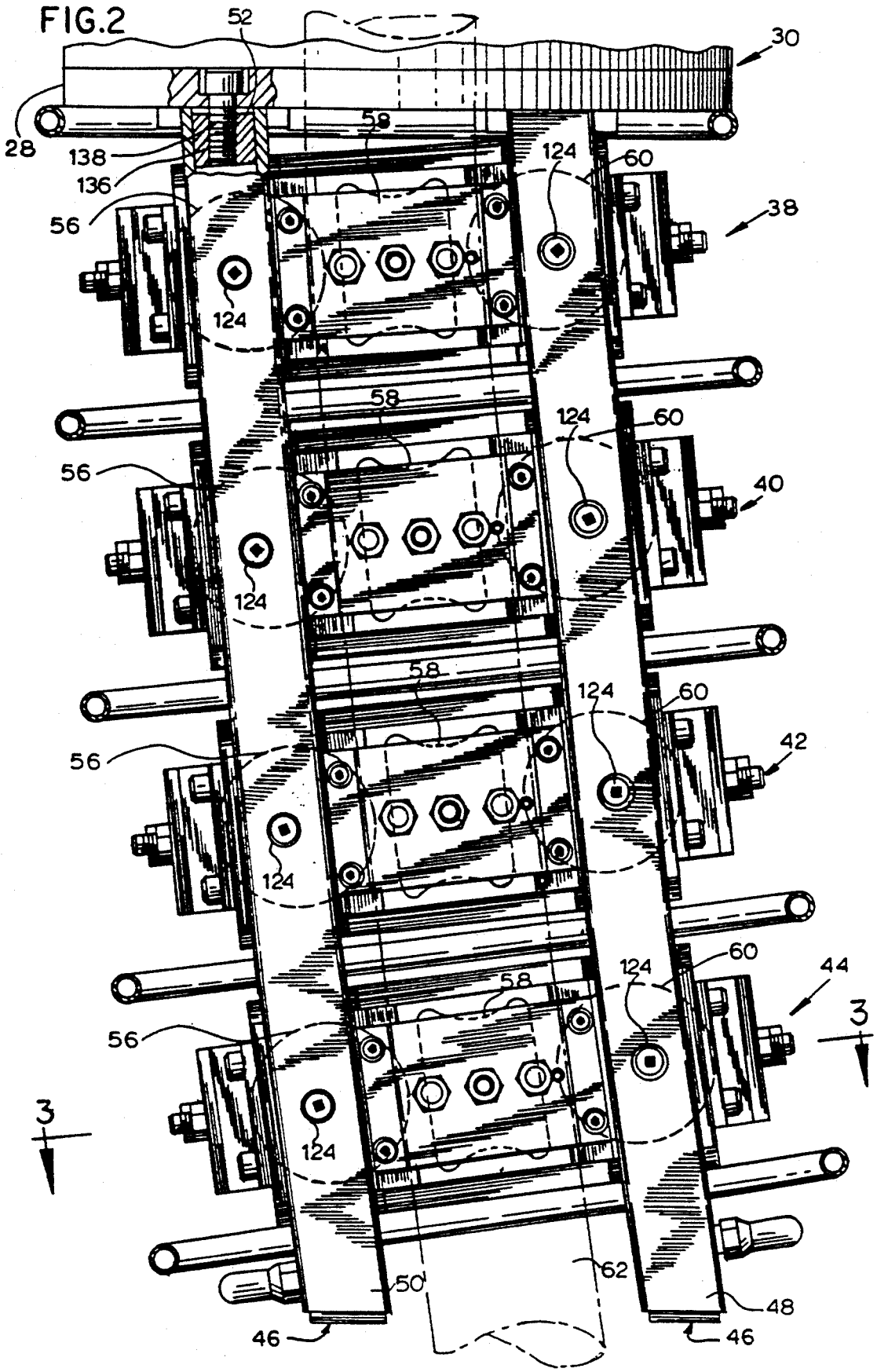
FIG. 2 is an elevational view of the modular billet mold scaffold in accordance with the present invention.

The top of each of the legs 48 and 50 is closed with a bar 138, for example, two inches square by $2\frac{1}{4}''$ long, and welded within the legs 48 and 50 to provide a watertight seal. The bar 138 is provided with a threaded aperture 140 as best shown in FIGS. 2 and 6 to enable the mold scaffold 30 to be attached to the billet mold 28 by way of the fasteners 52. Additional apertures 142 may be drilled into the legs 48 and 50 for attachment to either a water supply or spray nozzle which are used to cool the billets as they pass through the mold scaffold 30.

Obviously, various modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A mold scaffold for use in a continuous casting process comprising:

a plurality of modules, each module including a plurality of roller assemblies carried by a module frame for providing rolling support for billets;

a frame for carrying said modules, formed from a plurality of legs, each leg formed to a predetermined casting radius;

each leg being provided with a plurality of predrilled apertures to enable said roller assemblies of said modules to be rigidly secured to said frame along said predetermined casting radius and to be readily disassembled therefrom upon occurrence of damage during the continuous casting process; and means for adjusting the position of said roller assemblies relative to said module frame.

2. A mold scaffold as recited in claim 1, further including means for cooling said billets.

3. A mold scaffold as recited in claim 1, wherein each leg of said frame is formed to carry cooling water.

4. A mold scaffold as recited in claim 1, wherein said plurality of modules is four.

5. A mold scaffold as recited in claim 1, wherein said plurality of roller assemblies is four.

6. A mold scaffold for use in a continuous casting process comprising:

a plurality of modules, each module including a module frame for carrying a plurality of roller assemblies for providing rolling support for billets, each roller assembly carrying one or more rollers about a predetermined axis;

means for adjusting the position of said rollers relative to said module frame along a direction generally perpendicular to said predetermined axis;

means for carrying said modules in a predetermined casting radius;

each roller assembly including a generally U-shaped bracket defining two spaced apart depending legs and bight portion, said depending legs provided with aligned apertures for carrying an axle defining said predetermined axis; and means for securing said roller assembly to said module frame and allowing easy disassembly and replacement of said roller assembly.

7. A mold scaffold as recited in claim 6, further including means for preventing rotation of said axle relative to said module frame.

8. A mold scaffold as recited in claim 7, wherein said preventing means includes keys formed on opposing ends of said axle, adapted to be received in spaced apart keyways formed in said module frame.

9. A mold scaffold as recited in claim 6, wherein said securing means generally includes a hat-shaped bracket which includes a pair of spaced apart flanges adapted to be rigidly secured to said module frame.

10. A mold scaffold as recited in claim 6, wherein said carrying means includes a plurality of legs formed to a predetermined casting radius.

11. A mold scaffold as recited in claim 10, wherein each of said legs includes a plurality of predrilled apertures to enable said modules to be secured to said legs along said predetermined casting radius.

12. A mold scaffold as recited in claim 10, wherein each leg is formed to carry cooling water.

* * * * *